US006743466B2

(12) United States Patent
Flosbach et al.

(10) Patent No.: US 6,743,466 B2
(45) Date of Patent: Jun. 1, 2004

(54) PROCESS FOR REPAIRING COATED SUBSTRATE SURFACES

(75) Inventors: Carmen Flosbach, Wuppertal (DE); Karl-Friedrich Doessel, Wuppertal (DE); Werner Lenhard, Wuppertal (DE); Oliver Reis, Witten (DE); Thomas Fey, Mainz (DE)

(73) Assignee: E. I. du Pont de Nemours and Company, Wilmington, DE (US)

( * ) Notice: Subject to any disclaimer, the term of this patent is extended or adjusted under 35 U.S.C. 154(b) by 24 days.

(21) Appl. No.: 09/921,815

(22) Filed: Aug. 3, 2001

(65) Prior Publication Data

US 2003/0026895 A1 Feb. 6, 2003

(51) Int. Cl.[7] ..... B05D 3/06; B05D 7/14

(52) U.S. Cl. ..... 427/142; 427/508; 427/516; 427/521; 427/140; 427/142; 427/146; 427/147; 427/148; 427/149; 427/150; 427/152; 427/154; 427/155; 427/156; 427/407.1; 427/409

(58) Field of Search ..... 427/508, 516, 427/521, 140, 142, 146, 147, 148, 149, 150, 152, 154, 155, 156, 407.1, 409

(56) References Cited

U.S. PATENT DOCUMENTS 4,246,315 A * 1/1981 Kopp et al. ..... 428/317.7
4,568,589 A * 2/1986 Briggs ..... 428/63
4,661,182 A * 4/1987 Lerner ..... 156/94
5,166,007 A * 11/1992 Smith et al. ..... 428/63
5,387,304 A 2/1995 Berner et al.
6,221,439 B1 4/2001 Negele et al.

FOREIGN PATENT DOCUMENTS

| | | |
|---|---|---|
| DE | 19654918 A1 | 1/1998 |
| EP | 0251546 A2 | 1/1988 |
| EP | 0361351 B1 | 4/1990 |
| WO | WO 00/08094 | 2/2000 |
| WO | WO 00/63015 | 10/2000 |

* cited by examiner

*Primary Examiner*—Shrive P. Beck
*Assistant Examiner*—Jennifer Kolb Michener
(74) *Attorney, Agent, or Firm*—Bart E. Lerman

(57) ABSTRACT

The invention relates to a process for repairing coated substrate surfaces comprising the following successive steps:

a) optionally preparing a blemished area to be repaired, b) providing a backing film coated on one side with an uncured or at least partially cured coating layer of a coating composition curable by means of high energy radiation, c) applying the backing film with its coated side onto the blemished area to be repaired, d) irradiating the coating applied in this manner onto the blemished area to be repaired with high energy radiation and e) removing the backing film, wherein the coating is irradiated through the backing film and/or after removing the backing film.

10 Claims, No Drawings

PROCESS FOR REPAIRING COATED SUBSTRATE SURFACES

FIELD OF THE INVENTION

The invention relates to a process for repairing coated substrate surfaces by means of radiation-curable coating compositions. The process may find application particular for repairing small coating blemishes in automotive and industrial coating.

DESCRIPTION OF RELATED ART

It is known to use coating compositions curable by high-energy radiation in automotive coating and likewise in automotive repair coating. Coating compositions based on free-radically polymerizable binders are in particular used in such applications. This application also utilizes the advantages of radiation-curable coating compositions, such as, the very short curing times, the low solvent emission of the coating compositions and the good hardness and scratch resistance of the resulting coatings.

When repairing coating blemishes, it is often unnecessary to completely recoat an entire vehicle or vehicle part, for example, a bonnet. In the case of small coating blemishes, it is usually sufficient to recoat the area immediately surrounding the blemished area (spot repair). The preparation, coating and clean-up effort expended by the finisher is here largely independent of the size of the coating blemish to be repaired. For example, operations, such as, preparing the coating material and spray gun, putting on the breathing mask, applying the coating with a spray gun, cleaning the spray gun and other equipment or containers must always be carried out.

There is accordingly a requirement in repair coating for a simplified processes to repair small coating blemishes, in particular also in those cases in which only a top coat is to be repaired.

Prior art processes are known in which, as an alternative to conventional spray application, coated films are applied onto the substrate to be treated, for example, an automotive body. The films may here be provided on one side with one or more coating layers and may have on the same or the other side an adhesive layer so that the film can be fixed to the substrate. Where appropriate binders are used, the coating and/or adhesive layers may also be cured by ultraviolet light (UV) radiation. Such films and corresponding application processes have often been described in the literature, for example in WO-A-00/08094, WO-A-00/63015, EP-A-251 546 and EP-A-361 351. In general, the film is laminated onto the substrate, where it remains. DE-A-196 54 918 describes coating film usable for decorative purposes that comprises a "free coating film". The coating film comprises an adhesive layer and at least one coating layer. It is possible to dispense with a stabilizing backing film in this case.

SUMMARY OF THE INVENTION

The process according to the invention provides a process for repairing coated substrate surfaces by means of radiation-curable coating compositions, which process is in particular suitable for repairing small blemished areas, for example, in the context of repair coating in automotive original coating or in a repair bodyshop and permits the performance of the repair to the required quality quickly and straightforwardly without major preparation and clean-up effort.

The present invention relates to a process for repairing coated substrate surfaces comprising the following successive steps:

a) optionally preparing a blemished area to be repaired, b) providing a backing film coated on one side with an uncured or at least partially cured coating layer of a coating composition curable by means of high energy radiation, c) applying the backing film with its coated side onto the blemished area to be repaired, d) irradiating the coating applied in this manner onto the blemished area to be repaired with high energy radiation and e) removing the backing film, wherein the coating is irradiated through the backing film and/or after removing the backing film.

DETAILED DESCRIPTION OF THE EMBODIMENTS

It has surprisingly been found that, using the process according to the invention, it is possible quickly and straightforwardly to repair in particular small coating blemishes without any reduction in quality in comparison with conventional processes. Smooth, optically faultless surfaces are obtained which have the good hardness and solvent resistance typical of UV cross-linking systems.

Steps d) and e) are preferably performed in such a manner that irradiation proceeds through the backing film, the backing film is removed after irradiation and irradiation is optionally performed again after removal of the backing film. It is also possible, but less preferred, to irradiate the coating only after removal of the backing film.

The individual steps of the process according to the invention are explained in greater detail below.

In general, the blemished area to be repaired is prepared prior to the repair. In this case, the process according to the invention begins with step a), namely preparation of the blemished area to be repaired. This involves preparing the damaged coating in accordance with the requirements of the repair. Normally, the coating is initially thoroughly cleaned, for example, with a silicone remover. The surface may then be sanded lightly with rubbing compound or sandpaper and optionally cleaned once again. If necessary, a putty composition, for example, may be applied and appropriately post-treated. Alternatively, the blemished area may also be prepared by laser treatment.

Step b) of the process according to the invention comprises the provision of a backing film coated on one side with an uncured or at least partially cured coating layer of a coating composition curable by means of high energy radiation. The backing film comprises films made from any desired, in particular thermoplastic, plastics that meet certain requirements with regard to UV transmittance and heat resistance. In the case of the preferred embodiment of irradiation in which high energy radiation is passed through the backing film, the films must transmit UV radiation and be resistant to the temperatures that arise in the film material on irradiation with UV radiation. The films must also be resistant to the temperatures optionally required for partially gelling/tackifying the applied coating layer. Suitable film materials are, for example, polyolefins, such as, polyethylene, polypropylene, polyurethane, polyamide and polyesters, such as, polyethylene terephthalate and polybutylene terephthalate. Films may also consist of polymer blends and also may be optionally surface-treated. It is also possible for the films to have a textured surface, for example, a micro- and/or macrotextured surface. The thickness of the films may, for example, be between 10 and 1000 μm, preferably, between 10 and 500 μm, particularly preferably, between 20 and 250 μm and is determined by practical considerations of processability. The films selected should preferably be those that are elastic and extensible and cling effectively to the substrate by electrostatic forces.

The backing films are coated on one side with liquid or pasty coating compositions curable by means of high energy radiation. The coating compositions may be aqueous, diluted with solvents or contain neither solvents nor water. The coating compositions curable by irradiation with high energy radiation are cationically and/or free-radically curable coating compositions known to the person skilled in the art, wherein free-radically curable coating compositions are preferred.

Cationically curable coating compositions that are to be applied onto the backing film in the process according to the invention contain one or more cationically polymerizable binders. These may comprise conventional binders known to the person skilled in the art, such as, polyfunctional epoxy oligomers containing more than two epoxy groups per molecule. These comprise, for example, polyalkylene glycol diglycidyl ethers, hydrogenated bisphenol A glycidyl ethers, epoxyurethane resins, glycerol triglycidyl ether, diglycidyl hexahydrophthalate, diglycidyl esters of dimer acids, epoxidised derivatives of (methyl)cyclohexene, such as, for example 3,4-epoxycyclohexylmethyl (3,4-epoxycyclohexane) carboxylate or epoxidized polybutadiene. The number average molar mass of the polyepoxy compounds is preferably below 10,000. Reactive diluents, such as, cyclohexene oxide, butene oxide, butanediol diglycidyl ether or hexanediol diglycidyl ether, may also be used.

The cationically curable coating compositions contain one or more photoinitiators. Photoinitiators that may be used are onium salts, such as, diazonium salts and sulfonium salts.

Free-radically curable coating compositions that are preferably to be applied onto the backing film in the process according to the invention contain one or more binders with free-radically polymerizable olefinic double bonds. Suitable binders having free-radically polymerizable olefinic double bonds that may be considered are, for example, all the binders known to the skilled person that can be cross-linked by free-radical polymerization. These binders are prepolymers, such as, polymers and oligomers containing, per molecule, one or more, preferably on average 2 to 20, particularly preferably 3 to 10 free-radically polymerizable olefinic double bonds. The polymerizable double bonds may, for example, be present in the form of (meth)acryloyl, vinyl, allyl, maleate and/or fumarate groups. The free-radically polymerizable double bonds are particularly preferably present in the form of (meth)acryloyl groups.

Both here and below, (meth)acryloyl or (meth)acrylic are respectively intended to mean acryloyl and/or methacryloyl or acrylic and/or methacrylic.

Examples of prepolymers or oligomers include (meth) acryloyl-functional poly(meth)acrylates, polyurethane (meth)acrylates, polyester (meth)acrylates, unsaturated polyesters, polyether (meth)acrylates, silicone (meth) acrylates, epoxy (meth)acrylates, amino (meth)acrylates and melamine (meth)acrylates. The number average molar mass Mn of these compounds may be, for example, 500 to 10,000 g/mole, preferably 500 to 5,000 g/mole. The binders may be used individually or as a mixture. (Meth)acryloyl-functional poly(meth)acrylates and/or polyurethane (meth)acrylates are preferably used.

The prepolymers may be used in combination with reactive diluents, i.e., free-radically polymerizable low molecular weight compounds with a molar mass of below 500 g/mole. The reactive diluents may be mono-, di- or polyunsaturated. Examples of monounsaturated reactive diluents include: (meth)acrylic acid and esters thereof, maleic acid and semi-esters thereof, vinyl acetate, vinyl ethers, substituted vinylureas, styrene, vinyltoluene. Examples of diunsaturated reactive diluents include: di(meth)acrylates, such as, alkylene glycol di(meth)acrylate, polyethylene glycol di(meth)acrylate, 1,3-butanediol di(meth)acrylate, vinyl (meth)acrylate, allyl (meth)acrylate, divinylbenzene, dipropylene glycol di(meth)acrylate, hexanediol di(meth) acrylate. Examples of polyunsaturated reactive diluents are: glycerol tri(meth)acrylate, trimethylolpropane tri(meth) acrylate, pentaerythritol tri(meth)acrylate, pentaerythritol tetra(meth)acrylate. The reactive diluents may be used alone or in mixture.

Preferred free-radically curable coating compositions contain one or more photoinitiators, for example, in quantities of 0.1 to 5 wt-%, preferably of 0.5 to 3 wt-%, relative to the sum of free-radically polymerizable prepolymers, reactive diluents and photoinitiators. Examples of photoinitiators are benzoin and derivatives thereof, acetophenone and derivatives thereof, for example 2,2-diacetoxyacetophenone, benzophenone and derivatives thereof, thioxanthone and derivatives thereof, anthraquinone, 1-benzoylcyclohexanol, organophosphorus compounds, such as, acylphosphine oxides. The photoinitiators may be used individually or in combination.

It is possible, although less preferred, for the coating compositions curable by means of high energy radiation to contain, in addition to the binder components free-radically and/or cationically polymerizable by means of high energy radiation, or in addition to the free-radically and/or cationically polymerizable functional groups, further binder components or further functional groups that are chemically cross-linkable by an additional curing mechanism. Further chemically cross-linking binders that may preferably be used are one-component binder systems, for example, based on OH-functional compounds, amino resins and/or blocked polyisocyanates and those based on carboxy-functional and epoxy-functional compounds. Moisture-curing binder components are also possible, for example, compounds with free isocyanate groups, with hydrolyzable alkoxysilane groups or with ketimine- or aldimine-blocked amino groups. In the event that the coating compositions contain binders or functional groups that cure by means of atmospheric humidity, certain conditions must be maintained during preparation of the coating backing films in order to avoid premature curing. This issue is addressed in greater detail below in the description of the form of the coated backing film. The additional functional groups and the free-radically and/or cationically polymerizable functional groups may be present in the same binder and/or in separate binders.

The coating compositions that may be used in the process according to the invention for coating the backing film may be pigmented or unpigmented coating compositions. Unpigmented coating compositions are, for example, coating compositions formulated in conventional manner as clear coats. Pigmented coating compositions contain colour-imparting and/or special effect-imparting pigments. Suitable colour-imparting pigments are any conventional coating pigments of an organic or inorganic nature. Examples of inorganic or organic colour-imparting pigments are titanium dioxide, micronized titanium dioxide, iron oxide pigments, carbon black, azo pigments, phthalocyanine pigments, quinacridone or pyrrolopyrrole pigments. Examples of special effect-imparting pigments are metal pigments, for example, made from aluminium or copper; interference pigments, such as, metal oxide coated metal pigments, titanium dioxide coated mica.

The coating compositions may also contain transparent pigments, soluble dyes and/or extenders. Examples of usable fillers are silicon dioxide, aluminium silicate, barium sulfate, calcium carbonate and talc.

The coating compositions may also contain conventional coating additives. Examples of conventional coating additives include levelling agents, rheological agents, such as, highly disperse silica or polymeric urea compounds, thickeners, for example, based on partially cross-linked, carboxy-functional polymers or on polyurethanes, defoamers, wetting agents, anticratering agents, catalysts, antioxidants and light stabilizers based on HALS products and/or UV absorbers. The additives are used in conventional amounts known to the person skilled in the art.

The coating compositions may contain water and/or organic solvents. The latter comprise conventional organic coating solvents known to the person skilled in the art.

The coating compositions curable by means of high energy radiation may be applied onto the backing film by conventional methods, for example, by brushing, roller coating, pouring, blade coating or spraying. The coating composition may be applied as a melt or in the liquid phase, for example, as a solution. The coating compositions may, for example, be blade coated as a solution. In the subsequent drying process, the solvent is allowed to evaporate, optionally, with gentle heating. The coating must in no event be completely cross-linked during the drying process. The dried, uncross-linked coating should advantageously be slightly tacky at room temperature in order to ensure good adhesion onto the substrate to be repaired. The coating may either be intrinsically tacky due to specially formulated binders or tackiness may be achieved by slight partial cross-linking/gelling of the dried coating, for example, by heating and/or by UV irradiation. The coating compositions curable by means of high energy radiation are generally applied in layer thickness of 1 to 100 $\mu$m, preferably of 5 to 60 $\mu$m.

It is in principle possible, although not preferred, for the backing film to be provided with more than one coating layer, for example, with a pigment base coat and a transparent clear coat. In the latter case, the clear coat would first be applied onto the backing film and then the base coat would be applied onto the clear coat, for example, wet-on-wet and optionally, after a flash-off phase.

One possible development of the coating backing film consists in applying the coating with a layer thickness that reduces towards the edges of the film so that, when it is subsequently applied, edge marks in the existing coating are avoided.

In order to facilitate subsequent removal of the backing film from the substrate to be repaired, it may be advantageous to leave at least one edge zone of the backing film uncoated. It may also be advantageous to provide a special finish on the side of the backing film that is to be coated, for example, a release coating, or to use special surface-treated films, for example, films surface-modified with silicate layers, in order, on removal of the backing film, to facilitate detachment from the coating that is fixed to the substrate to be repaired.

It may also be advantageous to provide the coated backing film with a temporary protective film to provide protection. The protective film may here be present only on the coated side of the backing film, but it may also be applied onto both sides and completely enclose the entire coated backing film. The latter possibility would in particular be advisable in the event of presence of the above-described moisture-curing binder or functional groups in order to exclude atmospheric humidity. In order to protect the coating on the backing film from premature polymerisation brought about by UV radiation, a transparent or colored, for example, a black film material that does not transmit UV radiation may be used advantageously. For example, a black polyethylene film may be used. In order to facilitate detachment of the protective film, it too may also be provided with non-stick properties, as described above.

The coated films, optionally provided with protective film or protective envelope, may be prefabricated and stored in the most varied shapes and sizes, for example, in sizes of 0.5 $cm^2$ to 400 $cm^2$, preferably of 1 $cm^2$ to 100 $cm^2$. The films may also be stored as a reel of continuous film.

After provision of a coated backing film and removal of an optionally present protective film or protective envelope, the backing film is applied with its coated side onto the blemished area to be repaired in accordance with step c) of the process according to the invention. Favourably, a film sheet size is selected that perfectly fits over the blemished area, taking account of any uncoated edge zones or layer thicknesses that reduce towards the edges. As already mentioned, the blemished area may be sanded lightly or roughened before application of the coated backing film in order to ensure good adhesion. The film then is laminated onto the substrate, preferably with exposure to pressure and, optionally, heat, so fixing the coating onto the substrate to be coated. This can be carried out, for example, with a heatable roller, such as, a rubber roller. Coating layers comprising a blemished area to be repaired that may be considered are, for example, electrodeposition coated substrates, putty, primer, filler and base coat layers, but in particular, clear coat and single layer top coat layers. The coated backing film may here be applied either onto the damaged coating layer or onto an underlying layer. The latter case arises, for example, if the blemished area is sanded down to one of the underlying coating layers, for example, during preparation for the repair.

After application of the coated backing film with its coated side onto the blemished area to be repaired, the coating applied in this manner is irradiated with high energy radiation, preferably with UV radiation. Irradiation may here be performed through the backing film and/or the coating is directly irradiated after removal of the backing film.

The preferred source of radiation comprises UV radiation sources emitting UV light in the wave length range from 180 to 420 nm, in particular from 200 to 400 nm. Examples of such UV radiation sources are optionally doped high, medium and low pressure mercury vapour emitters, gas discharge tubes, such as, low pressure xenon lamps and UV lasers.

Apart from these continuously operating UV radiation sources, however, it is also possible to use discontinuous UV radiation sources. These are preferably so-called high-energy flash devices (UV flash lamps for short). The UV flash lamps may contain a plurality of flash tubes, for example, quartz tubes filled with inert gas such as xenon. The UV flash lamps have an illuminance of at least 10 megalux, preferably from 10 to 80 megalux per flash discharge. The energy per flash discharge may be, for example, 1 to 10 kJoule.

The irradiation time with UV radiation when UV flash lamps are used as the UV radiation source may be, for example, in the range from 1 millisecond to 400 seconds, preferably from 4 to 160 seconds, depending on the number of flash discharges selected. The flashes may be triggered, for example, about every 4 seconds. Curing may take place, for example, by means of 1 to 40 successive flash discharges.

If continuous UV radiation sources are used, the irradiation time may be in the range from a few seconds to about 5 minutes, preferably less than 5 minutes. The distance between the UV radiation sources and the surface to be irradiated may be, for example 5 to 60 cm.

When the coatings are irradiated by means of UV radiation, in particular with UV flash lamps, temperatures may be generated on the coating that are such that, in the event that the coating compositions cure by an additional cross-linking mechanism as well as polymerisation, they give rise to at least partial curing by means of this additional cross-linking mechanism.

In order to cure the coating compositions by means of the additional cross-linking mechanism, the coatings may, however, also be exposed to relatively high temperatures of for example 60 to 140° C. to cure completely. Complete curing may take place by conventional methods, for example, in an oven or in a conveyor unit, for example, with hot air or infrared radiation. Depending upon the curing temperature, curing times of 1 to 60 minutes are possible. It is, of course, also possible to perform the additional thermal curing prior to irradiation. An appropriately heat-resistant film material must be selected depending upon the curing temperatures required for the additional thermal curing. The temperature sensitivity of the substrate to be repaired must also be taken into consideration when selecting the curing temperature.

For coating compositions that are curable by UV radiation but not enhanced by an additional crosslinking mechanism, it is preferred to supply additional thermal energy, for example, with an infra-red lamp, to support the polymerisation (hardening) of the composition.

In the preferred case of irradiation with UV radiation though the backing film, the film is removed after irradiation. In the case of additional thermal curing, the coating is first allowed to cool before the film is removed. When removing the backing film, it is favourable if the film is uncoated on at least one edge zone so as to facilitate detachment of the film.

One development of the invention consists in effecting a partial cure of the coating by UV irradiation through the film and performing final curing in a second irradiation step after removal of the film. In other words, the radiation dose required for complete cure (by means of free-radical and/or cationic polymerisation) is supplied in at least two separate irradiation steps. In the event that the coating contains binders that cure by an additional cross-linking mechanism, it also possible in a first step completely or partially to cure the coating with regard to the free-radical and/or cationic polymerisation by means of UV radiation and, after removal of the film, firstly to perform any outstanding final curing with regard to free-radical and/or cationic polymerisation by means of UV radiation and then to supply thermal energy for further curing by means of the additional cross-linking mechanism.

After removal of the backing film and optional subsequent final curing and preferably a cooling phase, the repaired area may be polished.

It is, in principle, also possible to apply more than one coated backing film, for example two coated backing films, in succession onto the blemished area to be repaired. Depending upon requirements, this may, for example, comprise one backing film coated with a base coat and one coated with a clear coat or one backing film coated with a filler and one coated with a one-layer top coat.

If a backing film provided with a textured surface is coated and applied according to the invention, repair coated surfaces provided with the corresponding negative textures are obtained after removal of the backing film. This may, for example, prove necessary when repairing per se textured substrate surfaces.

Substrates which are suitable for the process according to the invention are any desired substrates, for example, metal, plastic, or composite substrates made from metal and plastic components.

The process according to the invention may find application for repairing any desired coated substrates, for example, in industrial and automotive coating, for example, in repair coating of automotive bodies in automotive original coating (end-of-line repair) or in a repair bodyshop. The process according to the invention may particularly advantageously be used for repairing small blemished areas (spot repairs). In particular, clear coats or pigmented one-layer top coats may be applied onto an existing multilayer coating for repair purposes by the process according to the invention.

The following example is intended to illustrate the invention in greater detail.

EXAMPLE pbw=parts by weight wt-%=weight-%

A metal test sheet coated with an electrodeposition primer, a filler, a base coat and a clear coat having a blemished area of approx. 10 $cm^2$, only the clear coat being damaged, was repaired. The blemished area was first cleaned and lightly sanded.

Production of a Coated Backing Film

A polyurethane resin-curable by means of UV radiation was first produced as follows:

369.4 pbw of isophorone diisocyanate were combined with 0.6 pbw of methylhydroquinone and 80 pbw of butyl acetate in a 2 l four-necked flask with a stirrer, thermometer, dropping funnel and reflux condenser and heated to 80° C. A mixture of 193 pbw of hydroxyethyl acrylate and 0.5 pbw of dibutyltin dilaurate was added dropwise in such a manner that the reaction temperature did not rise above 100° C. 50 pbw of butyl acetate were used to rinse out the dropping funnel. The temperature was maintained at a maximum of 100° C. until an NCO-value of 10.1 was obtained. 300 pbw of a polycaprolactone triol (Capa 305 from Interox Chemicals) and 50 pbw of butyl acetate were then added. The reaction mixture was maintained at a maximum of 100° C. until an NCO-value of <0.5 was obtained. The mixture was then diluted with 69.6 pbw of butyl acetate. A colorless, highly viscous resin with a solids content of 75 wt-% (1 h/150° C.) and a viscosity of 10,000 mPas was obtained.

A clear coat curable by means of UV radiation was then produced from the following constituents:

80.8 wt-% of the polyurethane resin produced above 1.3 wt-% of a conventional commercial photoinitiator (Irgacure 184/CIBA)

0.1 wt-% of a conventional commercial levelling agent (Ebecryl 350/UCB)

0.8 wt-% of a conventional commercial UV absorbent (Tinuving 384/CIBA)

0.8 wt-% of a conventional commercial light stabiliser (HALS based) (Tinuving 292/ CIBA)

16.2 wt-% of butyl acetate.

The resultant clear coat was then applied onto a backing film. To this end, the clear coat was blade coated to a dry film thickness of approx. 40 μm onto one side of a 20 μm thick polyester film. The applied clear coat layer was dried for 10 minutes at 60° C. to evaporate the solvent. A slightly tacky, no longer flowable surface was obtained.

Application of the Coated Backing Film

A suitably sized piece of the film as coated above was laid with its coated side on the blemished area. The coating film was then heated through the film with an IR radiation emitter to approx. 80° C. and laminated without bubbles onto the blemished area under gentle pressure. The still warm and liquid coating material was then irradiated through the film by means of 5 flashes from a UV flash lamp (3000 Ws) at a distance of 20 cm. The UV-flashes were triggered every 4 seconds.

The film was then peeled off and the coating layer post-cured with 10 UV-flashes. The edges of the blemished area repaired in this manner were finally blended in by polishing.

The surface quality, hardness, gloss and solvent resistance achieved were comparable with those achieved with conventional UV-cured coatings. The repaired blemished area could be polished immediately after curing and left no edge marks in the existing coating.

What is claimed is:

1. A process for repairing coated substrate surfaces comprising the following successive steps:

a) optionally preparing a blemished area to be repaired, b) providing a backing film coated on one side with only an uncured or at least partially cured coating layer of a coating composition curable by means of high energy radiation, c) applying the backing film with its coated side onto the blemished area to be repaired, d) irradiating the coating applied in this manner onto the blemished area to be repaired with high energy radiation and e) removing the backing film, wherein the coating is irradiated through the backing film and/or after removing the backing film and the remaining applied layer after removal of the backing film is the coating composition of step b).

2. The process according to claim 1, wherein the coating is irradiated by initially performing partial curing by irradiation through the backing film and, after removing the backing film, performing further irradiation to complete the cure.

3. The process according to claim 1, wherein the uncured partially cured coating layer in step b) comprises a coating layer with a tacky surface.

4. The process according to claim 1, wherein the coating composition curable by means of high energy radiation comprises a coating composition with free-radically polymerizable binders.

5. The process according to claim 1, wherein in step b) a backing film with a protective film on one or both sides is provided.

6. The process according to claim 1, wherein the backing film of step c) is applied under pressure.

7. The process according to claim 1, wherein the backing film of step c) is applied under pressure and heat.

8. The process according to claim 1, wherein the irradiation of the coating applied onto the blemished area to be repaired is performed with UV radiation of a wavelength range of 180-400 nm.

9. The process according to claim 1 wherein the coated substrate surfaces repaired have small blemishes.

10. The process according to claim 1 wherein the coated substrate surfaces repaired are automotive or industrial coatings.

* * * * *